US009595429B2

(12) United States Patent
Shimada et al.

(10) Patent No.: US 9,595,429 B2
(45) Date of Patent: Mar. 14, 2017

(54) METHOD AND SYSTEM FOR ATOMIZING SAMPLE LIQUID USING ULTRASONIC TRANSDUCER TO BE ANALYZED BY MASS SPECTROMETRY

(71) Applicants: SHISEIDO COMPANY, LTD., Tokyo (JP); Bio Chromato, Inc., Kanagawa (JP)

(72) Inventors: Haruo Shimada, Kanagawa (JP); Yuka Morishita, Kanagawa (JP); Yoshimasa Nakatani, Kanagawa (JP); Kazumasa Kinoshita, Kanagawa (JP); Yasuo Shida, Tokyo (JP)

(73) Assignees: SHISEIDO COMPANY, LTD., Tokyo (JP); BIO CHROMATO, INC., Kanagawa (JP)

( * ) Notice: Subject to any disclaimer, the term of this patent is extended or adjusted under 35 U.S.C. 154(b) by 0 days.

(21) Appl. No.: 14/784,611

(22) PCT Filed: Apr. 14, 2014

(86) PCT No.: PCT/JP2014/060645
§ 371 (c)(1),
(2) Date: Oct. 15, 2015

(87) PCT Pub. No.: WO2014/171428
PCT Pub. Date: Oct. 23, 2014

(65) Prior Publication Data

US 2016/0079050 A1 Mar. 17, 2016

(30) Foreign Application Priority Data

Apr. 16, 2013 (JP) ..... 2013-085930

(51) Int. Cl.
*H01J 49/00* (2006.01)
*H01J 49/04* (2006.01)
*H01J 49/10* (2006.01)

(52) U.S. Cl.
CPC ..... *H01J 49/0454* (2013.01); *H01J 49/0031* (2013.01); *H01J 49/102* (2013.01)

(58) Field of Classification Search
CPC .... H01J 49/00; H01J 49/0454; H01J 49/0027; H01J 49/02; H01J 49/0431
(Continued)

(56) References Cited

U.S. PATENT DOCUMENTS 4,109,863 A * 8/1978 Olson ..... A61M 15/0085 128/200.16
4,570,068 A * 2/1986 Sakairi ..... H01J 49/0454 250/288
(Continued)

FOREIGN PATENT DOCUMENTS

JP 2004-179079 6/2004
JP 2012-054172 3/2012
(Continued)

OTHER PUBLICATIONS

Akihiko Kusai, "Fundamental and Application of the direct Analysis in Real Time Mass Spectrometry", Bunseki, Mar. 5, 2007 (Mar. 5, 2007), No. 3, whole No. 387, p. 124 to 127.
(Continued)

*Primary Examiner* — Wyatt Stoffa
*Assistant Examiner* — Jason McCormack
(74) *Attorney, Agent, or Firm* — IPUSA, PLLC

(57) ABSTRACT

A mass spectrometry method includes a step of atomizing liquid including a sample using an ultrasonic transducer; a step of transferring the atomized liquid; a step of generating ions from the transferred liquid using a DART ion source;
(Continued)

and a step of analyzing a mass spectrometry by introducing the generated ions into a mass spectrometer.

21 Claims, 7 Drawing Sheets

(58) Field of Classification Search
USPC ..... 250/281, 282, 285, 288
See application file for complete search history.

(56) References Cited

U.S. PATENT DOCUMENTS 5,400,665 A * 3/1995 Zhu ..... B23K 9/328 250/288
6,670,608 B1 * 12/2003 Taylor ..... H01J 49/0422 250/288
2003/0168592 A1 * 9/2003 Yamada ..... H01J 49/0422 250/288
2006/0285108 A1 * 12/2006 Morrisroe ..... F23C 99/003 356/316
2007/0131871 A1 6/2007 Chang et al.
2009/0272893 A1 * 11/2009 Hieftje ..... H01J 49/0463 250/282
2010/0096546 A1 * 4/2010 Ewing ..... H01J 49/0431 250/282
2013/0299692 A1 11/2013 Shimada et al.

FOREIGN PATENT DOCUMENTS

WO 2010114976 10/2010
WO 2012/090915 7/2012

OTHER PUBLICATIONS

International Search Report mailed on May 13, 2014.
Extended European Search Report mailed Oct. 27, 2018.

* cited by examiner

METHOD AND SYSTEM FOR ATOMIZING SAMPLE LIQUID USING ULTRASONIC TRANSDUCER TO BE ANALYZED BY MASS SPECTROMETRY

BACKGROUND OF THE INVENTION

1. Field of the Invention

The present invention relates to a mass spectrometry method, an ion generator and a mass spectrometry system.

2. Description of the Related Art

Although various methods are known as an atmospheric pressure ionization method, Direct Analysis in Real Time (DART) has been focused on, recently.

The DART is a method in which atoms or molecules at an electronic excited state are collided with water in air to generate protons by penning ionization and the protons are added to a sample for ionization. For example, a sample M can be ionized as follows in the case of using helium at a metastable excited state as "He($2^3$S)".

$$He(2^3S)+H_2O \rightarrow H_2O^{+*}+He(1^1S)+e^-$$

$$H_2O^{+*}+H_2O \rightarrow H_3O^++OH^*$$

$$H_3O^++nH_2O \rightarrow [(H_2O)_nH]^+$$

$$[(H_2O)_nH]^++M \rightarrow MH^++nH_2O$$

Patent document 1 discloses a mass spectrometry method in which a sample is heated to generate gas, and using the DART, ions generated from the gas are introduced into a mass spectrometer to analyze a mass spectrometry.

Patent Document

[Patent Document 1] WO2012/090915

However, thermal decomposition may be occurred occasionally, so that it is desired to suppress thermal decomposition of the sample when performing an atomizing step of the sample.

SUMMARY OF THE INVENTION

The present invention is made considering to solve the above problems, and provides a new mass spectrometry method and an ion generator capable of suppressing thermal decomposition when atomizing a sample.

According to an embodiment, there is provided a mass spectrometry method including a step of atomizing liquid including a sample using an ultrasonic transducer; a step of transferring the atomized liquid; a step of generating ions from the transferred liquid using a DART ion source; and a step of analyzing a mass spectrometry by introducing the generated ions into a mass spectrometer.

According to an embodiment, there is provided an ion generator including an atomizing unit that atomizes liquid including a sample using an ultrasonic transducer;

a transferring unit that transfers the atomized liquid; and a DART ion source that generates ions from the transferred liquid.

According to the embodiments, a mass spectrometry method and an ion generator capable of suppressing thermal decomposition when atomizing a sample can be provided.

DETAILED DESCRIPTION OF THE PREFERRED EMBODIMENTS

Next, the invention will be described herein with reference to illustrative embodiments.

Figure 1:
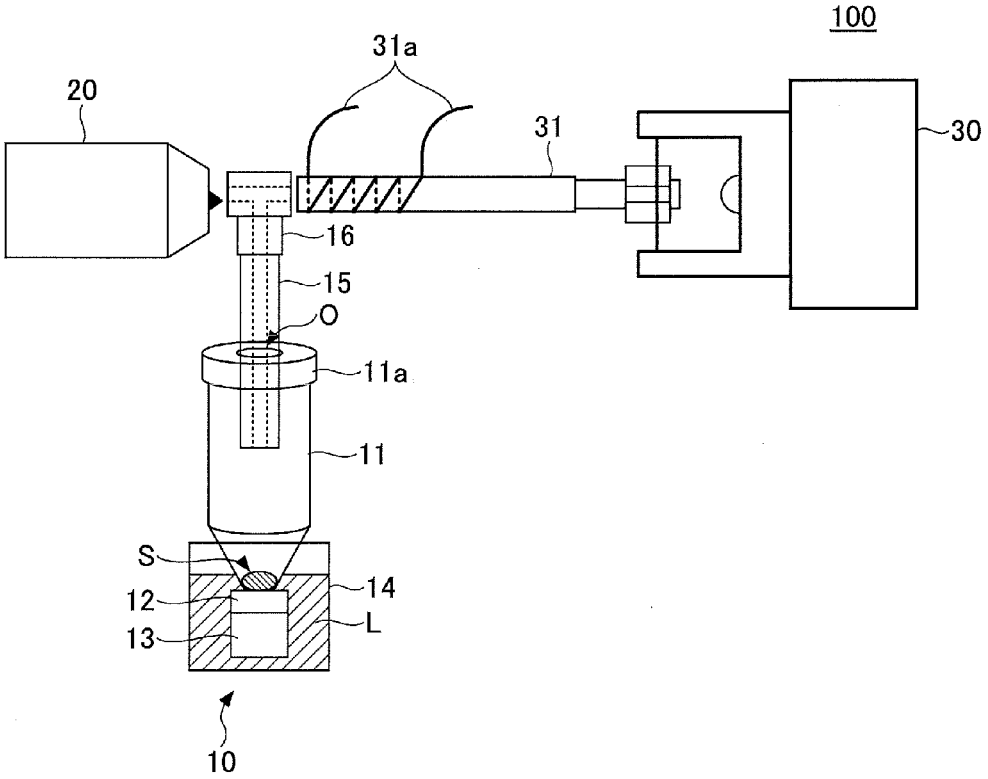
FIG. 1 is a schematic view illustrating an example of a mass spectrometry system.

FIG. 1 illustrates an example of a mass spectrometry system.

A mass spectrometry system 100 includes an ultrasonic atomizer 10, a DART ion source 20 and a mass spectrometer 30.

Then, a mass spectrometry method using the mass spectrometry system 100 is explained.

First, after introducing 0.3 to 10 mL of sample solution S in a tube 11 with a cap, the tube 11 with a cap is held by a holding member 12. At this time, the holding member 12 is fixed on an ultrasonic transducer 13 in a container 14 in which liquid L is introduced, and the tube 11 with a cap is held such that to contact with the liquid L. Thus, the sample solution S can be atomized by applying voltage to the ultrasonic transducer 13 using a power source (not illustrated in the drawings). Further, a cap 11*a* of the tube 11 with a cap is provided with an open portion O and a tube 15 is inserted in the open portion O. Thus, the atomized sample solution S is transferred in the tube 15. Further, a three way cock 16 is provided at an outlet port side of the tube 15.

The oscillation frequency of the ultrasonic transducer 13 is, generally, 10 kHz to 10 MHz and is preferably, 100 kHz to 3 MHz.

As the ultrasonic transducer 13, not specifically limited, piezoelectric ceramics or the like may be used.

The inner diameter of the tube 15 is, generally, 5 to 20 mm.

The length of the tube 15 is, generally, 0.05 to 2 m.

Fluororesin, polyether ether ketone, silicone resin or the like may be coated on an inner wall of the tube 15.

Figure 2:
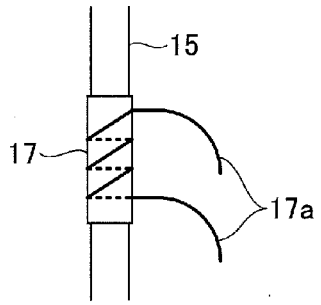
FIG. 2 is a schematic view illustrating an example of a method of heating a tube of FIG. 1.

A heating tube 17 may be attached at an outer surface of the tube 15 (see FIG. 2). At this time, as a resistor heating line 17*a* is wound around the heating tube 17, the heating tube 17 can be heated by applying voltage to the resistor heating line 17*a* using a power source (not illustrated in the drawings). With this, adhesion of the atomized sample solution S to the tube 15 can be suppressed.

Here, as the atomized sample solution S tends to adhere to a side of the tube 15 where the atomized sample solution S is introduced, generally, it is preferable that the heating tube 17 is attached to the side of the tube 15 where the atomized sample solution S is introduced.

The temperature of the inner wall of the heating tube 17 when heating the heating tube 17 is, generally, 50 to 400° C., and preferably, 100 to 300° C.

Here, as the method of heating the tube 15, it is not limited to the method of attaching the heating tube 17, and a method of heating using a ceramic fiber heater, a method of heating by irradiating micro-wave, a method of heating using a hot air blower or the like may be used.

As the material composing the heating tube 17, it is not specifically limited as long as having a heat resistance property, and ceramics, a glass, Teflon (registered trademark), a stainless steel, a niobium steel, a tantalum steel or the like may be used.

As the material composing the resistor heating line 17*a*, not specifically limited, a metal heater element such as an iron-chrome-aluminum based alloy, a nickel-chrome based alloy or the like; a high melting point metal heater element such as platinum, molybdenum, tantalum, tungsten or the like; a non-metal heater element such as silicon carbide, molybdenum-silicide, carbon or the like, or the like may be used.

For example, when a nickel-chromium based alloy (nichrome) wire whose diameter is 0.26 mm is used as the resistor heating line 17*a*, current of 1 to 6 A is flowed.

Here, when atomizing the sample solution S, it is preferable to suppress mixing of sample solution S that is atomized into the tube 15. With this, ions can be efficiently generated from the sample included in the atomized sample solution S.

Figure 3:
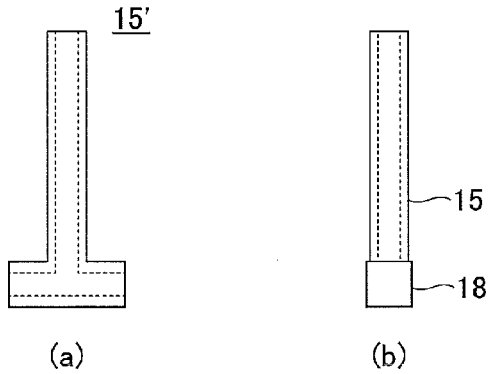
FIG. 3 is a schematic view illustrating a method of suppressing mixing of liquid that is not atomized.

As the method of suppressing mixing of the sample solution S that is not atomized may be, not specifically limited, a method of providing a tube 15' in which open portions at an inlet port side are formed in a direction substantially perpendicular to a direction at which the atomized sample solution S is generated (see FIG. 3-(*a*)), a method of providing a filter 18 at an open portion at an inlet port side of the tube 15 (see FIG. 3 (*b*)) or the like may be used.

The pore size of the filter 18 is, generally, 0.1 to 2 mm.

Next, using the DART ion source 20, helium at a metastable excited state "He($2^3$S)" is collided with water in air to generate protons by penning ionization, and ions generated by irradiating the protons on the atomized sample solution S in the three way cock 16 are introduced from an ion introduction pipe 31 of the mass spectrometer 30 to analyze a mass spectrometry. At this time, the inside of the ion introduction pipe 31 is decompressed by a compressor (not illustrated in the drawings). With this, the ions generated from the sample included in the atomized sample solution S are introduced into the mass spectrometer 30.

The temperature of a gas heater of the DART ion source 20 is, generally, room temperature to 200° C., and preferably, room temperature to 100° C. When the temperature of the gas heater of the DART ion source 20 exceeds 200° C., the sample may be thermally decomposed.

At this time, as a resistor heating line 31*a* is wound around the ion introduction pipe 31 of the mass spectrometer 30, the mass spectrometry of the ions generated from the sample can be analyzed by heating the ion introduction pipe 31 by applying voltage to the resistor heating line 31*a* using a power source (not illustrated in the drawings). With this, adhesion of the ions generated from the sample to the ion introduction pipe 31 can be suppressed.

Here, as the ions generated from the sample tends to adhere to a side of the ion introduction pipe 31 where the ions generated from the sample are introduced, generally, it is preferable that the resistor heating line 31*a* is wound around at the side of the ion introduction pipe 31 where the ions generated from the sample are introduced.

The temperature of the inner wall of the ion introduction pipe 31 when heating the ion introduction pipe 31 is, generally, 50 to 400° C., and preferably, 100 to 300° C.

Here, as the method of heating the ion introduction pipe 31, it is not limited to the method of winding the resistor heating line 31*a*, and a method of heating using a ceramic fiber heater, a method of heating by irradiating micro-wave, a method of heating using a hot air blower or the like may be used.

Further, the ion introduction port may be directly heated by detaching the ion introduction pipe 31.

Further, when the ions generated in the ion introduction pipe 31 hardly adhere, the ion introduction pipe 31 may not be heated.

As the material for composing the ion introduction pipe 31, it is not specifically limited as long as having a heat resistance property, and ceramics, a glass, Teflon (registered trademark), a stainless steel, a niobium steel, a tantalum steel or the like may be used.

Fluororesin, polyether ether ketone, silicone resin or the like may be coated on an inner wall of the ion introduction pipe 31.

As the material composing the resistor heating line 31*a*, not specifically limited, a metal heater element such as an iron-chromium-aluminum based alloy, a nickel-chromium based alloy or the like; a high melting point metal heater element such as platinum, molybdenum, tantalum, tungsten or the like; a non-metal heater element such as silicon carbide, molybdenum-silicide, carbon or the like, or the like may be used.

For example, when a nichrome wire whose diameter is 0.26 mm is used as the resistor heating line 31*a*, current of 1 to 6 A is flowed.

As the sample, it is not specifically limited as long as it is possible to generate ions using the DART ion source 20, and an organic compound, a high molecular compound or the like may be used.

As the solvent included in the sample solution S, not specifically limited, water, methanol, ethanol, acetonitrile or the like may be used, and two or more of them may be used together.

Moreover, sample dispersion (or suspension) may be used instead of the sample solution S.

As dispersion (or suspension) medium included in the sample dispersion, not specifically limited, water, methanol, ethanol, acetonitrile or the like may be used, and two or more of them may be used together.

Further, when the sample is liquid, the sample may be used instead of the sample solution S.

As the liquid L, not specifically limited, water or the like may be used.

Figure 4:
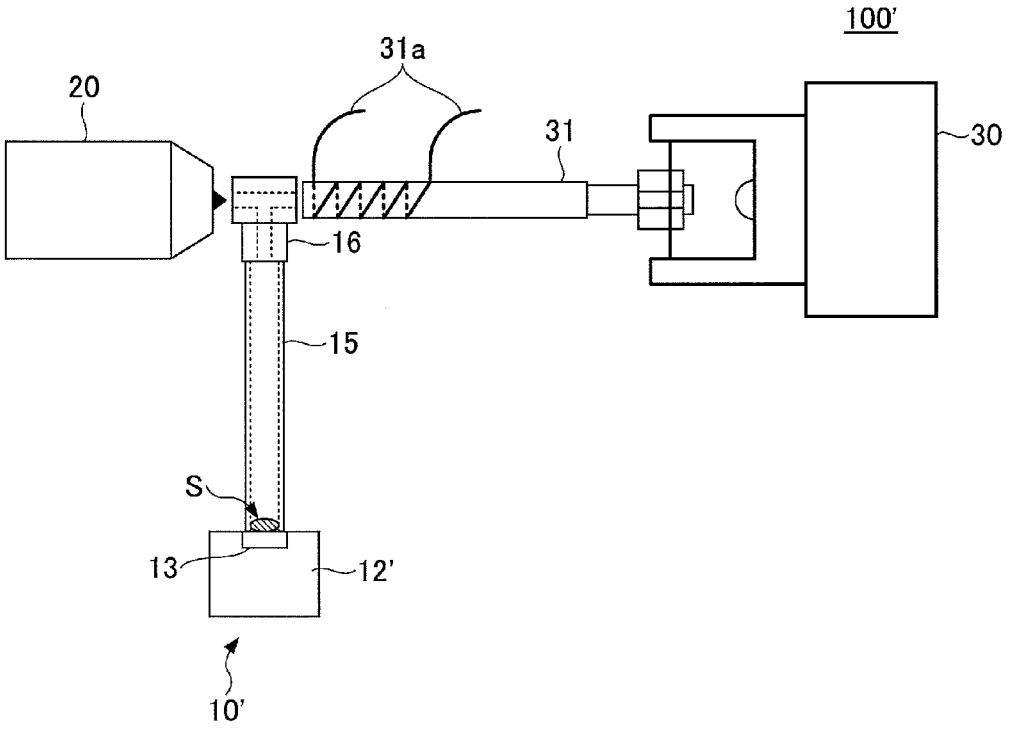
FIG. 4 is a schematic view illustrating another example of the mass spectrometry system.

FIG. 4 illustrates another example of the mass spectrometry system. Here, in FIG. 4, the same components as those of FIG. 1 are given the same reference numerals, and explanations are not repeated.

The mass spectrometry system 100' has the same structure as the mass spectrometry system 100 except that including an ultrasonic atomizer 10' instead of the ultrasonic atomizer 10.

Next, a mass spectrometry method using the mass spectrometry system 100' is explained.

First, 1 to 10 uL of sample solution S is dropped on the ultrasonic transducer 13 that is held by a holding member 12'. With this, by applying voltage to the ultrasonic transducer 13 using a power source (not illustrated in the drawings), the sample solution S can be atomized. Further, the tube 15 is provided around the dropped sample solution S.

Thus, the atomized sample solution S is transferred in the tube 15. Further, the three way cock 16 is provided at the outlet port side of the tube 15.

Next, using the DART ion source 20, helium at a metastable excited state "He($2^3$S)" is collided with water in air to generate protons by penning ionization, and ions generated by irradiating the protons on the atomized sample solution S in the three way cock 16 are introduced from the ion introduction pipe 31 of the mass spectrometer 30 to analyze a mass spectrometry. At this time, the inside of the ion introduction pipe 31 is decompressed by a compressor (not illustrated in the drawings). Accordingly, the ions generated from the sample included in the atomized sample solution S are introduced into the mass spectrometer 30.

Here, instead of the metastable excited state helium He($2^3$S), metastable excited state neon, metastable excited state argon, metastable excited state nitrogen or the like may be used.

Example 1

After introducing 100 mL of water, as the liquid L, and an ultrasonic atomization unit M-011 (manufactured by SEIKO GIKEN INC.) including the ultrasonic transducer 13 in a 200 mL beaker, as the container 14, the holding member 12 was fixed such that its height became 30 mm. Next, 500 μL of 0.67 mg/mL solution of glycyrrhizinic acid (solvent: water/acetonitrile=2/1 (volume ratio)), as the sample solution S, was introduced in a 50 mL centrifuge conical tube made of plastic (manufactured by Corning Incorporated), as the tube 11 with a cap. At this time, an open portion O whose inner diameter was 8 mm was formed in the cap 11*a* of the centrifuge tube and the tube 15 whose inner diameter was 6 mm and length was 150 mm was inserted therethrough. Further, the three way cock 16 was provided at the outlet port side of the tube 15 (see FIG. 1).

Next, the mass spectrometry of the ions generated from the atomized sample solution S were analyzed using the mass spectrometry system 100. Specifically, first, using the DART ion source 20, helium at a metastable excited state "He($2^3$S)" was collided with water in air to generate protons by penning ionization, and ions generated by irradiating the protons on the atomized sample solution S were introduced into the mass spectrometer 30 to analyze a mass spectrometry. At this time, the temperature of the inner wall of the ion introduction pipe 31 was 150° C. by heating the ion introduction pipe 31 by flowing current of 4 A through the resistor heating line 31*a*.

Here, DART SVP (manufactured by IonSense Inc.) was used as the DART ion source 20, and the temperature of the gas heater was 50° C. Further, micrO-TOFQII (manufactured by Bruker Daltonics K.K.) was used as the mass spectrometer 30, and the measurement mode was set at a negative ion mode. Further, a tube made of ceramics with an outer diameter of 6.2 mm, an inner diameter of 4.7 mm and a length of 94 mm was used as the ion introduction pipe 31, and the resistor heating line 31*a* was wound around at a region from the side at which the ions were introduced for 35 mm. At this time, a nichrome wire whose diameter was 0.26 mm was used as the resistor heating line 31*a*.

Figure 5:
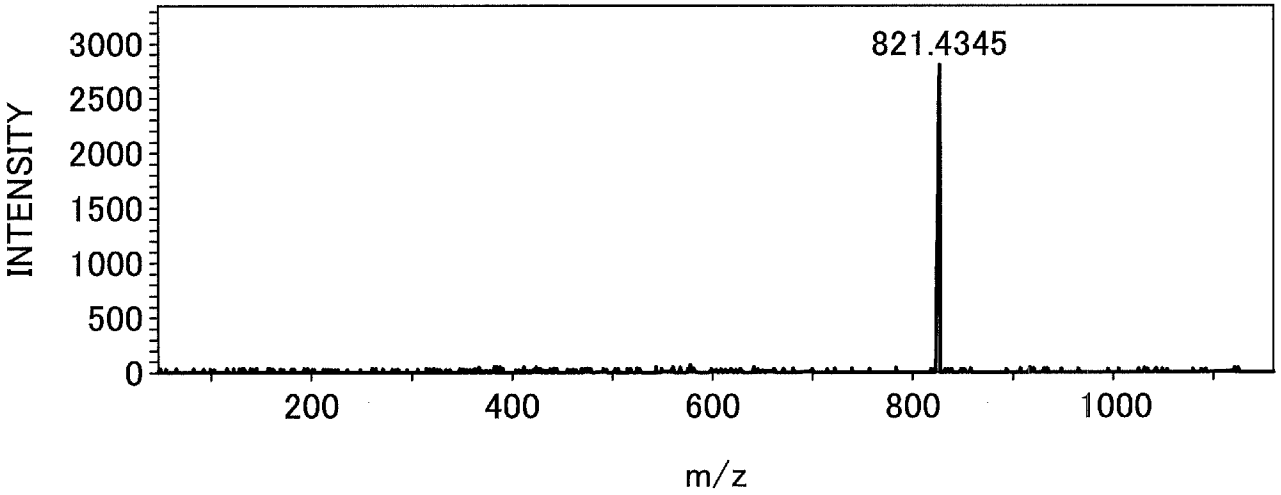
FIG. 5 is a mass spectrum of glycyrrhizinic acid of Example 1.

FIG. 5 illustrates a mass spectrum of glycyrrhizinic acid.

From FIG. 5, while a molecular ion peak of glycyrrhizinic acid ($[M-H]^-$) whose m/z is 821 is observed, a peak resulted from a thermal decomposition product of glycyrrhizinic acid is not observed, and it can be understood that thermal decomposition could be suppressed and a structure of glycyrrhizinic acid was analyzed.

Comparative Example 1

A glass rod R was immersed in 0.67 mg/mL solution of glycyrrhizinic acid (solvent: water/acetonitrile=2/1 (volume ratio)) to adhere glycyrrhizinic acid to the glass rod R.

Figure 6:
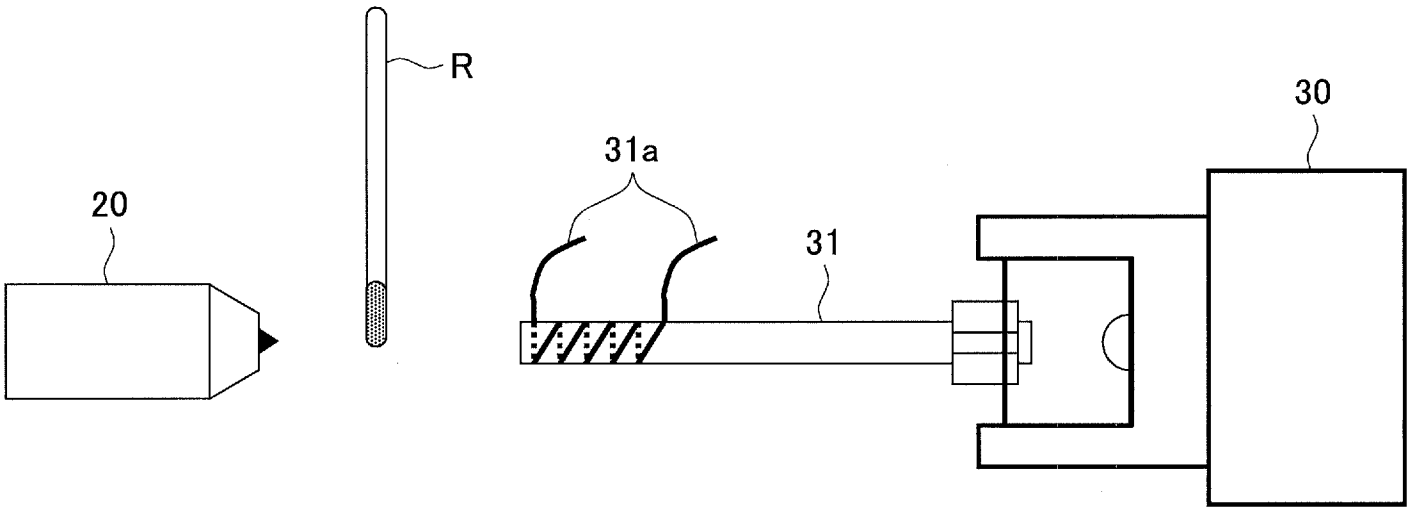
FIG. 6 is a schematic view illustrating a mass spectrometry method of comparative example 1.

A mass spectrometry was analyzed similarly as Example 1 except that the glass rod R to which glycyrrhizinic acid was adhered was used instead of the ultrasonic atomizer 10, and the temperature of the gas heater was changed to 450° C. (see FIG. 6).

Figure 7:
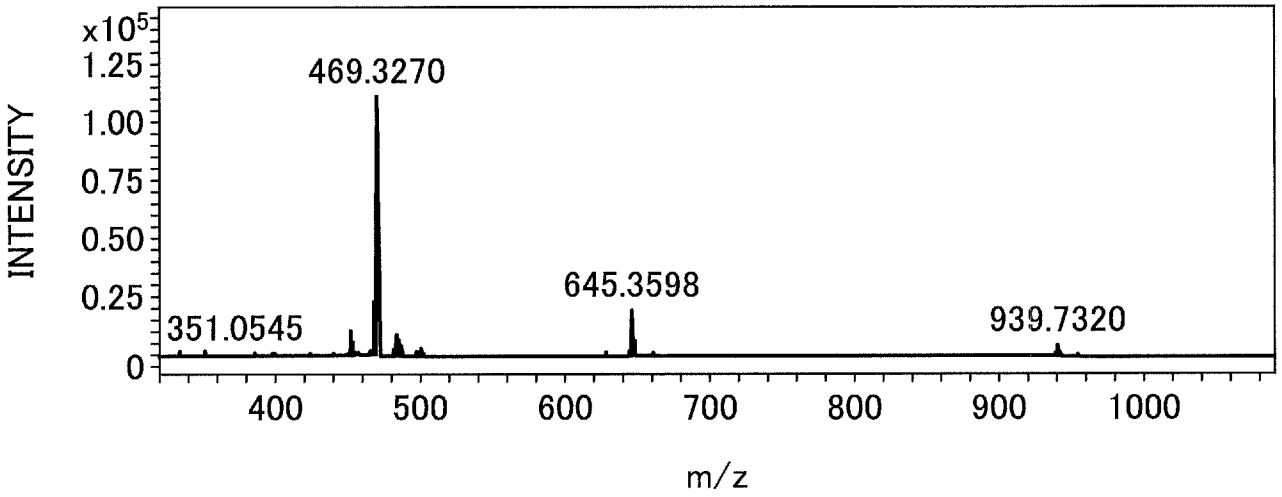
FIG. 7 is a mass spectrum of glycyrrhizinic acid of comparative example 1.

FIG. 7 illustrates a mass spectrum of glycyrrhizinic acid.

From FIG. 7, while a molecular ion peak of glycyrrhizinic acid ($[M-H]^-$) whose m/z is 821 is not observed, a peak resulted from a thermal decomposition product of glycyrrhizinic acid is observed, and it can be understood that glycyrrhizinic acid was thermally decomposed.

Figure 8:
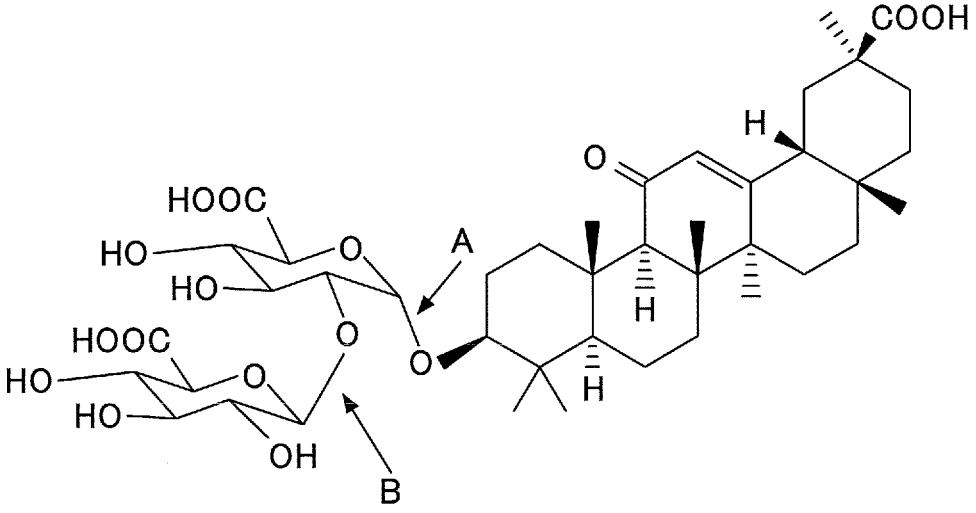
FIG. 8 is a view for explaining thermal decomposition of glycyrrhizinic acid.

Here, a peak whose m/z is 469 is resulted from a sugar portion that is eliminated when a bond "A" is cut. Further, a peak whose m/z is 645 is resulted from a sugar portion that is eliminated when a bond "B" is cut. Further, a peak whose m/z is 940 is resulted from a dimer of sugar portions eliminated when the bond "A" is cut (see FIG. 8).

Comparative Example 2

A mass spectrometry was analyzed similarly as comparative example 1 except that the temperature of the gas heater was changed to 50° C.

Figure 9:
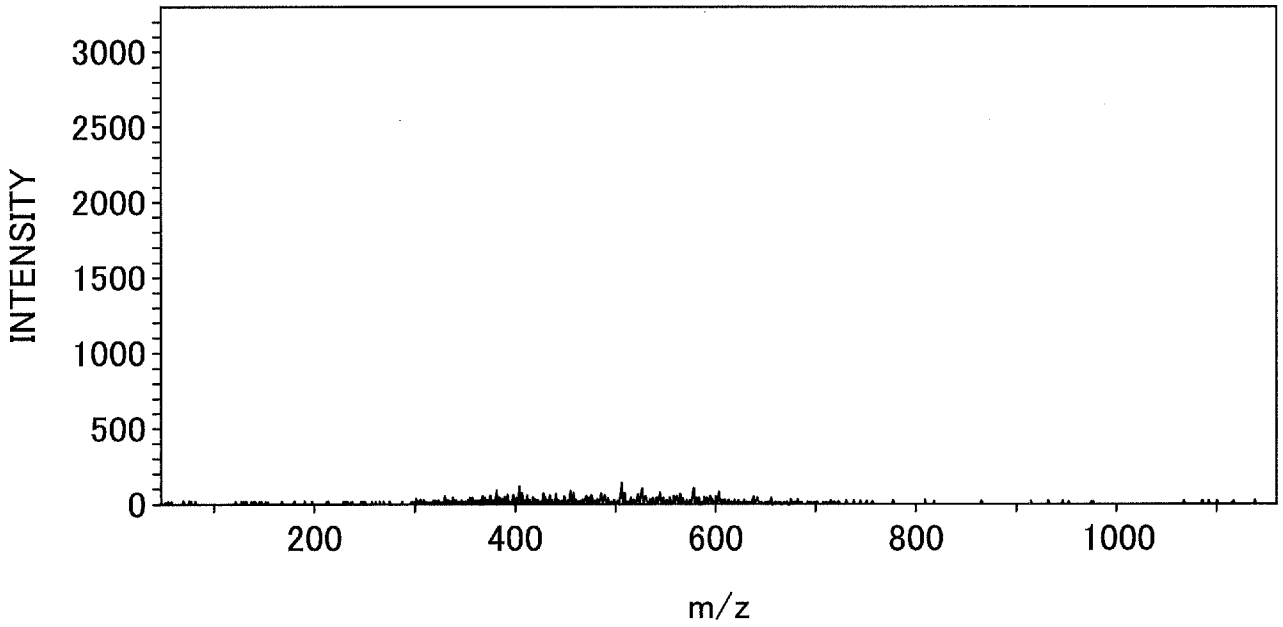
FIG. 9 is a mass spectrum of comparative example 2.

FIG. 9 illustrates a mass spectrum.

From FIG. 9, a molecular ion peak of glycyrrhizinic acid ($[M-H]^-$) whose m/z is 821 and a peak resulted from a thermal decomposition product of glycyrrhizinic acid are not observed, and it can be understood that glycyrrhizinic acid was not atomized from the surface of the glass rod R.

The present application is based on and claims the benefit of priority of Japanese Priority Application No. 2013-085930 filed on Apr. 16, 2013, the entire contents of which are hereby incorporated by reference.

NUMERALS

10, 10' ultrasonic atomizer
11 tube with a cap
11*a* cap
12, 12' holding member
13 ultrasonic transducer
14 container
15, 15' tube
16 three way cock
17 heating tube
17*a* resistor heating line
18 filter
20 DART ion source
30 mass spectrometer
31 ion introduction pipe
31*a* resistor heating line
100, 100' mass spectrometry system
L liquid
O open portion
S sample solution

What is claimed is:

1. A mass spectrometry method comprising:

atomizing sample liquid that includes a sample using an ultrasonic transducer at a first position;

transferring the atomized sample liquid upward in a vertical direction from the first position to a second position in a first tube that extends only in the vertical direction so that the atomized sample liquid is transferred upward in the first tube;

generating ions from the transferred atomized sample liquid at the second position using a DART ion source while further transferring the generated ions in a horizontal direction in an introduction pipe that is connected to the first tube via a three way cock and extends in the horizontal direction from the second position to a third position at which a mass spectrometer is provided; and analyzing a mass spectrum by introducing the generated ions into the mass spectrometer.

2. The mass spectrometry method according to claim 1, wherein when atomizing the sample liquid, mixing of a part of the sample liquid that is not atomized is suppressed.

3. An ion generator comprising:

an atomizing unit that includes an ultrasonic transducer and atomizes sample liquid that includes a sample using the ultrasonic transducer at a first position;

a transferring unit that includes a first tube that extends only in a vertical direction and transfers the atomized sample liquid upward in the vertical direction from the first position to a second position in the first tube so that the atomized sample liquid is transferred upward in the first tube;

a three way cock that is connected to the first tube;

a DART ion source that generates ions from the transferred atomized sample liquid at the second position; and an introduction pipe that is connected to the first tube via the three way cock and extends in the horizontal direction from the second position so that the generated ions are further transferred in the horizontal direction in the introduction pipe, the introduction pipe being connected to an end of the three way cock that is opposite to an end of the three way cock at which the DART ion source is provided.

4. The ion generator according to claim 3, wherein the atomizing unit includes a member or a mechanism that suppresses mixing of a part of the sample liquid that is not atomized.

5. A mass spectrometry system comprising:

the ion generator of claim 3; and a mass spectrometer provided at a third position that is apart from the second position in the horizontal direction.

6. The mass spectrometry method according to claim 1, wherein in the atomizing the sample liquid, the sample liquid is introduced in a second tube with a cap, the first tube is inserted in an open portion of the second tube, and the ultrasonic transducer is provided in liquid introduced in a container, wherein the second tube is held to contact the liquid.

7. The mass spectrometry method according to claim 6, wherein in the atomizing the sample liquid, the first tube is formed such that open portions at an inlet port side, from which the atomized sample liquid enters, are formed in a direction substantially perpendicular to a direction at which the atomized sample liquid is generated and mixing of the sample liquid that is not atomized is suppressed to enter the first tube.

8. The mass spectrometry method according to claim 6, wherein in the atomizing the sample liquid, the atomized sample liquid enters from an inlet port of the first tube through a filter, provided at the inlet port of the first tube, that suppresses mixing of the sample liquid that is not atomized.

9. The mass spectrometry method according to claim 1, wherein in the atomizing the sample liquid, the sample liquid is dropped on the ultrasonic transducer and the first tube is provided around the dropped sample liquid to surround the dropped sample liquid.

10. The mass spectrometry method according to claim 1, wherein the distance between the first position and the second position is at least 0.05 m.

11. The mass spectrometry method according to claim 1, wherein the distance between the first position and the second position is longer than the distance between the second position and the third position.

12. The mass spectrometry method according to claim 1, further comprising: heating the first tube in the transferring the atomized sample liquid.

13. A mass spectrometry method comprising:

atomizing sample liquid including a sample using an ultrasonic transducer at a first position;

transferring the sample atomized in the atomizing upward in a vertical direction from the first position to a second position in a first tube that extends only in the vertical direction so that the atomized sample liquid is transferred upward in the first tube;

further transferring the sample in a horizontal direction in an introduction pipe that is connected to the first tube and extends in the horizontal direction from the second position to a third position at which a mass spectrometer is provided; and analyzing a mass spectrum of the sample by introducing the sample into the mass spectrometer.

14. The mass spectrometry method according to claim 13, wherein in the further transferring the sample in the horizontal direction, the sample is transferred in the introduction pipe that is connected to the first tube via a three way cock.

15. The mass spectrometry method according to claim 13, wherein in the atomizing the sample liquid, the sample liquid is introduced in a second tube with a cap, the first tube is inserted in an open portion of the second tube, and the ultrasonic transducer is provided in liquid introduced in a container, wherein the second tube is held to contact the liquid.

16. The mass spectrometry method according to claim 15, wherein in the atomizing the sample liquid, the first tube is formed such that open portions at an inlet port side from which the atomized sample liquid enters are formed in a direction substantially perpendicular to a direction at which the atomized sample liquid is generated and mixing of the sample liquid that is not atomized is suppressed to enter the first tube.

17. The mass spectrometry method according to claim 15, wherein in the atomizing the sample liquid, the atomized sample liquid enters from an inlet port of the first tube through a filter, provided at the inlet port of the first tube, that suppresses mixing of the sample liquid that is not atomized.

18. The mass spectrometry method according to claim 13, wherein in the atomizing the sample liquid, the sample liquid is dropped on the ultrasonic transducer and the first tube is provided around the dropped sample liquid to surround the dropped sample liquid.

19. The mass spectrometry method according to claim 13, wherein the distance between the first position and the second position is at least 0.05 m.

20. The mass spectrometry method according to claim 13, wherein the distance between the first position and the second position is longer than the distance between the second position and the third position.

21. The mass spectrometry method according to claim 13, further comprising: heating the first tube in the transferring the atomized sample liquid.

* * * * *